US006852048B1

(12) United States Patent
Filippini

(10) Patent No.: US 6,852,048 B1
(45) Date of Patent: Feb. 8, 2005

(54) GUIDING AND VIBRATION DAMPENING STRING TUBES FOR SPORTS RACQUETS

(75) Inventor: Rafael G. Filippini, Chula Vista, CA (US)

(73) Assignee: EF Composite Technologies, L.P., San Diego, CA (US)

( * ) Notice: Subject to any disclaimer, the term of this patent is extended or adjusted under 35 U.S.C. 154(b) by 0 days.

(21) Appl. No.: 10/150,311

(22) Filed: May 17, 2002

(51) Int. Cl.[7] ..... A63B 49/02; A63B 49/08; A63B 51/00

(52) U.S. Cl. ..... 473/539; 473/540; 473/543

(58) Field of Search ..... 473/539–543, 473/524, 534, 545, 546

(56) References Cited

U.S. PATENT DOCUMENTS

| | | | | | |
|---|---|---|---|---|---|
| 2,089,118 | A | * | 8/1937 | Fritsch | 473/534 |
| 2,165,701 | A | * | 7/1939 | Goerke | 473/534 |
| 4,203,597 | A | * | 5/1980 | Reedhead et al. | 473/534 |
| 4,333,650 | A | * | 6/1982 | Soong | 473/537 |
| 4,437,662 | A | * | 3/1984 | Soong | 473/537 |
| 4,613,138 | A | * | 9/1986 | Haythornthwaite | 473/534 |
| 4,634,124 | A | | 1/1987 | Yuhas et al. | |
| 4,826,167 | A | | 5/1989 | Lo | |
| 4,828,259 | A | | 5/1989 | Davis | |
| 4,875,679 | A | | 10/1989 | Movilliat et al. | |
| 4,909,511 | A | | 3/1990 | DeVille et al. | |
| 4,919,438 | A | | 4/1990 | Yoneeyama | |
| 4,983,242 | A | | 1/1991 | Reed | |
| 5,039,096 | A | | 8/1991 | Chen | |
| 5,048,830 | A | | 9/1991 | Lo | |
| 5,054,779 | A | | 10/1991 | Marrello | |
| 5,071,125 | A | | 12/1991 | Shen | |
| 5,096,194 | A | | 3/1992 | Yong et al. | |
| 5,098,098 | A | | 3/1992 | Petralia | |
| 5,100,136 | A | | 3/1992 | Chen | |
| 5,106,086 | A | | 4/1992 | Acosta | |
| 5,133,552 | A | | 7/1992 | Feeney et al. | |
| 5,135,223 | A | | 8/1992 | You | |
| 5,137,273 | A | * | 8/1992 | Jseng | 473/543 |
| 5,141,228 | A | | 8/1992 | Soong | |
| 5,174,568 | A | | 12/1992 | You | |
| 5,197,732 | A | | 3/1993 | Lanctot | |
| 5,211,397 | A | | 5/1993 | Davis et al. | |
| 5,290,031 | A | | 3/1994 | Natsume | |
| 5,306,004 | A | * | 4/1994 | Soong | 473/522 |
| 5,374,057 | A | | 12/1994 | Lai et al. | |
| D368,749 | S | | 4/1996 | Severa et al. | |
| 5,919,104 | A | | 7/1999 | Mortvedt et al. | |
| 6,027,420 | A | * | 2/2000 | Soong | 473/540 |
| 6,062,994 | A | | 5/2000 | Grimes et al. | |
| 6,432,005 | B1 | | 8/2002 | Lin | |

FOREIGN PATENT DOCUMENTS

| | | | |
|---|---|---|---|
| GB | 2056288 | A | 3/1981 |

* cited by examiner

*Primary Examiner*—Raleigh W. Chiu
(74) *Attorney, Agent, or Firm*—Daspin & Aument, LLP; Jefferson Perkins

(57) ABSTRACT

A string guide system is disposed within the hollow stem of a sports racquet and guides the continuous string at least through a turn for redirecting the continuous string back out of the cavity and toward the string bed. The redirection defines shared ends of a pair of connected consecutive string segments. The string guide system disposes the string segments at predetermined lateral positions along the width at least at the turn. In a preferred embodiment the string guide system includes flexible tubes which dampen vibration and aid in stringing the racquet.

43 Claims, 9 Drawing Sheets

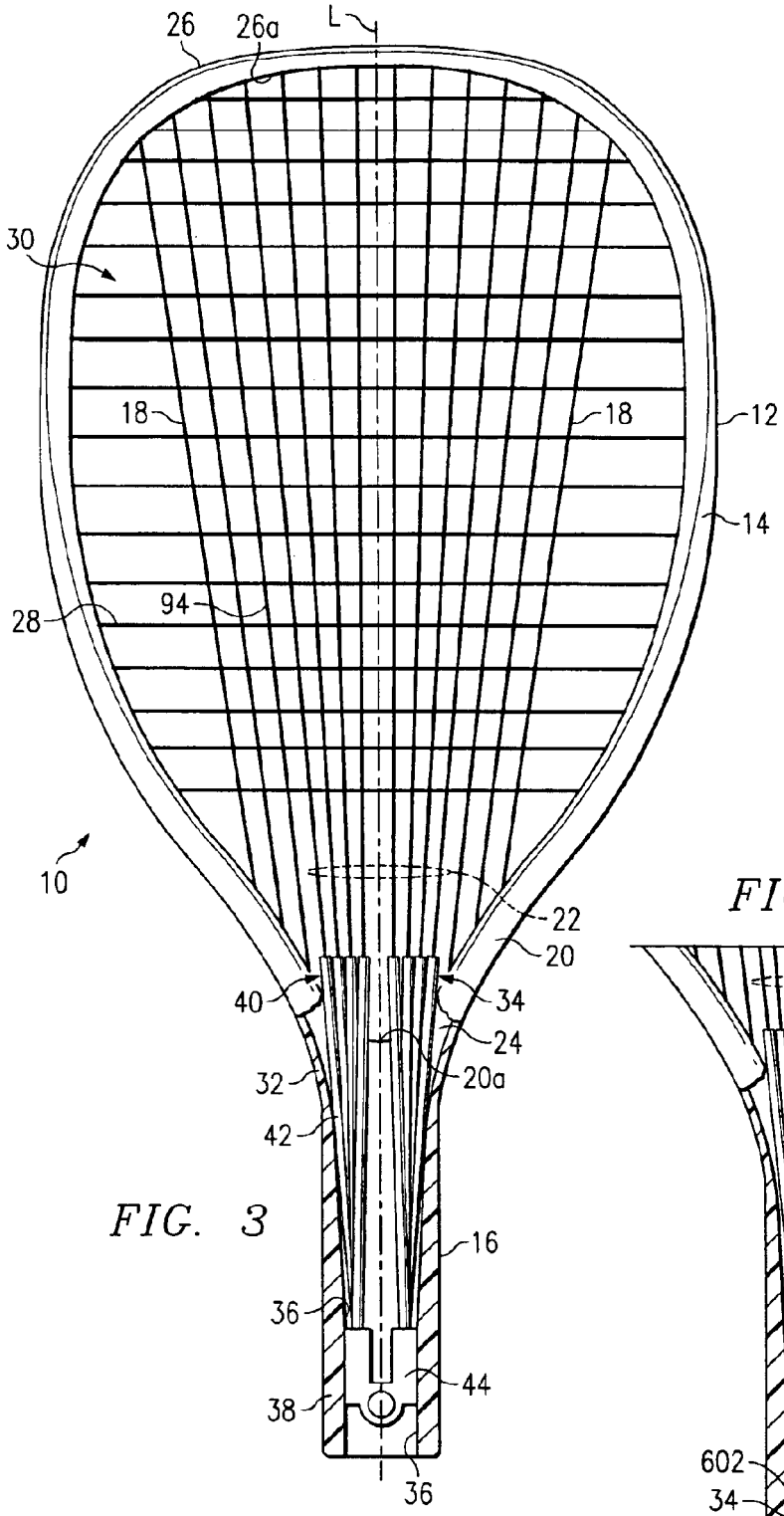
FIG. 3
FIG. 3A
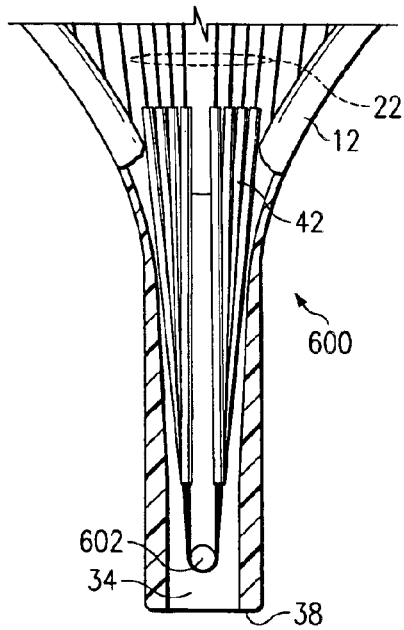

FIG. 9
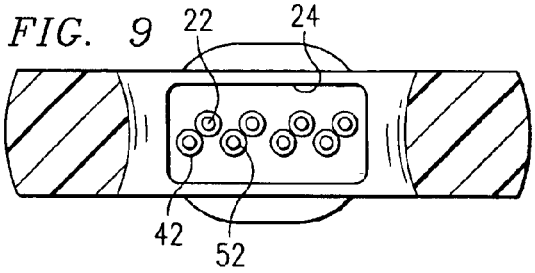
FIG. 9A
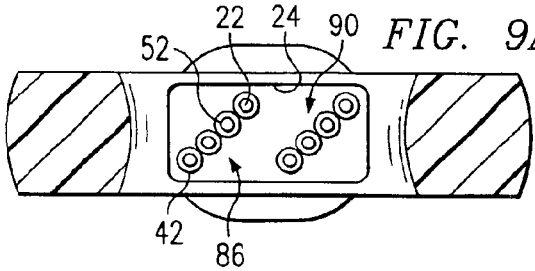
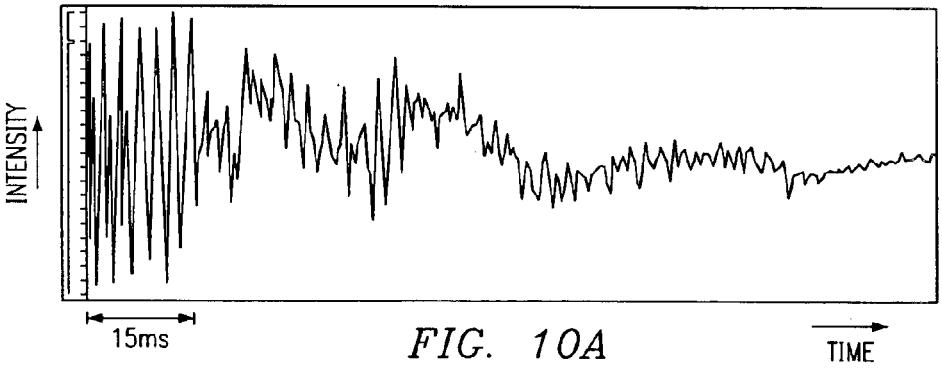
FIG. 10A
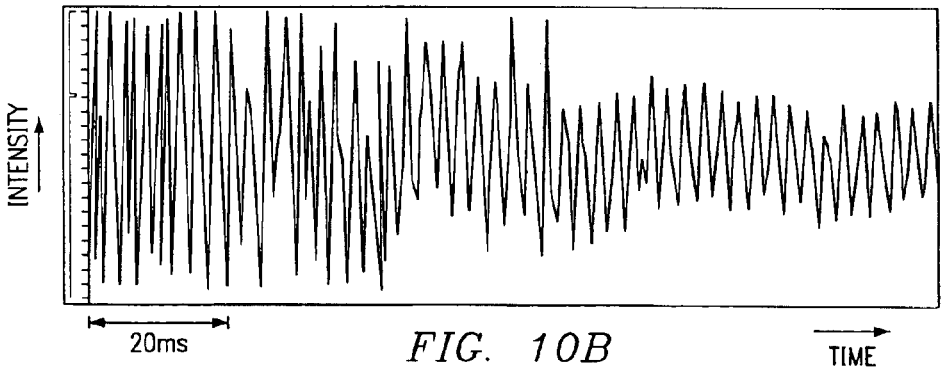
FIG. 10B

GUIDING AND VIBRATION DAMPENING STRING TUBES FOR SPORTS RACQUETS

TECHNICAL FIELD OF THE INVENTION

The present invention relates generally to sports racquets, such as racquetball racquets, tennis rackets, squash racquets and badminton racquets used for hitting a projectile such as a ball, and more particularly for string guide structures on sports racquets for easier stringing and dampening vibration of the strings during play.

BACKGROUND OF THE INVENTION

Sports racquets, such as racquet ball racquets and tennis rackets, have evolved with a number of objectives including the increase of power to hit a projectile, such as a ball or other propellable object such as a shuttlecock. Referring to FIG. 1, one type of known racquet 200 designed to increase power has a string bed 202 including main strings 204 that run the longitudinal direction of the racquet ("vertical" strings). Some of these main strings, indicated as 206, extend into a hollow handle 208 and are looped around a pin 210 near the bottom of the handle. These strings are called "long" strings hereinafter. The wrapping of the long string 206 around the pin 210 creates a fixed end for each long string 206 inside the handle at its far end (hereafter referred to as the "long" string configuration).

Referring to FIG. 2, the long string configuration is also provided for other types of racquets, such as a tennis racket 300 that has a shaft 302 connecting a head frame 304 and string bed 306 to a hollow handle 308. In this case, a pin 310 is also placed in the handle, and long strings 312 must run through the shaft for looping around pin 310.

Due to the lengthening of the long strings 206 and 312 into the handle, even though the string bed in such a racquet is about 15½ inches long (for racquetball and tennis racquets), the effective length of the main, long strings is about 22 inches (for racquetball racquets) or about 27–28 inches long (for tennis racquets). Long string racquets for other racquet sports such as squash and badminton will have commensurate increases in effective length. As a result, the long strings 206 and 312 provide greater deflection and "dwell" time with the ball (not shown), which stores greater energy. This in turn causes a ball to be propelled from a racquet with more power and speed. The long string configurations are disclosed, for example, in U.S. Pat. No. 5,919,104 issued to Mortvedt et al., which is entirely incorporated herein by reference.

The long string configuration, however, is difficult to string since the looping or anchoring pin or bearing 210, 310 is enclosed within the handle 208, 308 of the known racquets. The stringing of these racquets takes more time than is usual, as the stringer has to contend with a string that tends to coil or twine on itself and otherwise behave in an unruly fashion. Threading e.g. monofilament nylon strings through elongated cavities in handles and shafts is time-consuming and frustrating. Further, when inserting the strings 206, 312 into the handle and looping or bending them around the pin 210, 310, it is difficult to maintain a proper alignment of the long strings 206, 312 within the handle and on the pin relative to the alignment of the strings on the string bed. The string tends to end up being routed in an unplanned way.

At the pin 210, 310 itself, the strings 206, 312 may abut against each other while placing the string around the pin, and can become entangled due to crossing or further lateral movement of the strings on the pin. If a string is pulled around the pin and on top of another string, it can later roll off the bottom string and lose a portion of its tensioning.

Yet another problem that occurs while stringing the long string racquets is that once a string 206, 312 is bent around the pin 210, 310, emerges from the handle 208, 308 and is pulled into the string bed 202, 306, it can then be difficult for the stringer to determine where on the racquet head or head frame 214, 304 the string should be attached to next. This is especially true in string bed patterns where the strings are not necessarily strung through adjacent holes on the frame all the way around the frame (i.e. the string is laced through non-adjacent holes such as every other hole or every third hole).

Finally, the long strings 206, 312 are more directly attached to the handle via a pin, at least compared to known racquets that terminate their vertical strings on a head frame separated from the handle by a throat area. This direct contact with the handle transfers undesired forces more easily to the handle, such as vibration formed upon the racquet's impact with an object. Vibration can cause discomfort and tire the muscles of a user's hand and arm holding the racquet more quickly. This vibration is a particularly troublesome issue in long string racquet designs such as those shown in FIGS. 1 and 2.

SUMMARY OF THE INVENTION

The problems mentioned above are solved by the invention, which in a first aspect provides a sports racquet for hitting a projectile, and that has a racquet head with a frame and a string bed supported by the frame. A stem is attached to the frame and has inner walls defining a cavity. As used herein, "stem" can mean either a shaft, present in shafted racquets of the sort used in tennis, squash and badminton, or a handle, which in nonshafted racquets such as those used in racquetball are connected directly to the frame. The stem has a longitudinal axis extending the length of the stem and intersecting the string bed. At least one continuous string for forming the string bed includes a plurality of string segments that extend from the string bed and into the cavity of the stem. The string segments are also referred to herein as the main or long strings or sometimes just "strings." A string guide system is disposed within the stem and guides the continuous string at least through a turn for redirecting the continuous string back out of the cavity and toward the string bed. The redirection defines shared ends of a pair of connected consecutive string segments. The string guide system also defines a width that extends transversely to the longitudinal axis. The string guide system disposes the string segments at predetermined lateral positions along the width at least at the turn.

In a further aspect of the present invention, a number of preselected string segments extend from the string bed and into the cavity, which is preferably elongated. The stem defines an opening to the cavity that opposes the racquet head. The string guiding means guides the preselected string elements to respective predetermined fixed lateral positions within the cavity. It also redirects the strings back out of the cavity toward the string bed.

In a further aspect, elongate tubes reside at least partially within the cavity, and the strings are disposed within the tubes, which dampen vibration of the strings. In yet another aspect of the invention, these tubes have distal ends disposed near a string bearing and proximal ends near the string bed, and are used to string the strings through the cavity from and to the bearing.

In a further aspect of the invention, a sports racquet is provided with a string bed. At least some of the string segments making up the string bed have portions disposed between the string bed and their respective anchor points. Tubes according to the invention may be provided for these non-bed portions as dampening devices, stringing aids or both.

In yet another aspect of the present invention, the string guide system is disposed within the cavity and includes the tubes extending from a vicinity of the opening to a vicinity of the distal (or butt) end for receiving the strings. The string guide system also includes a string bearing assembly within the cavity and spaced away from the near end in a direction toward the distal end. The string bearing assembly has curvilinear channels with two ends, and bores for receiving the tubes. The tubes are disposed so as to communicate with each end of the channels. The tubes are continuous with the channels for receiving the string.

In still another aspect, the invention is directed to a method of stringing a string bed that includes the steps of:

(a) engaging an end of a string into a string guide system in a vicinity of a near end of the stem. The string guide system is disposed within a cavity defined by the stem. The near end of the stem is disposed near the string bed and defines an opening to the cavity.

(b) moving the string th rough the string guide system, including (1) directing the string toward a vicinity of a turning zone of the cavity, and (2) disposing the string at a predetermined lateral position relative to the longitudinal axis. The positions are located along a width of the string guide system. This ides the string through a turn to redirect the string in a direction back toward the string bed. By this turn or redirection, the string defines or includes pairs of consecutive string segments connected at a shared end disposed at the turn. This step also includes directing the string through the string-guide system back to the near end of the stem.

(c) extracting the end of the string from the string guide system and moving the string through the string bed.

(d) subsequently inserting the string end into a hole, or otherwise through an anchor port, formed on an inner surface of the frame for anchoring the string to the frame and extracting the end of the string through a hole on the inner surface of the frame. This moves the string back into the string bed.

(e) Finally, repeating steps (a) through (d) for forming a plurality of main long strings of the string bed. By this stringing method, each long string disposed within the cavity avoids entanglement with, and direct contact with, any other string segment in the cavity.

The present invention applies to sports racquets of both shafted and nonshafted varieties.

BRIEF DESCRIPTION OF THE DRAWINGS

The above mentioned and other features of the present invention and the manner of obtaining them will be apparent, and the invention itself will be best understood by reference to the following description of the preferred embodiment of the invention in conjunction with the following drawings, in which:

FIG. 3 is a front plan view and partial cross section of a racquet according to the present invention;

FIG. 3*a* is a partial front/sectional view of a racquet according to an alternative embodiment of the invention;

FIG. 9 is a cross-sectional view of a top segment of a handle on the racquet according to the present invention taken substantially along line 9—9 of FIG. 5;

FIG. 9A is a cross-sectional view of an alternative top segment of a handle on the racquet according to the present invention;

FIG. 10A is a graph showing vibration intensity for a racquet with tubes according to the present invention, as measured using a microphone;

FIG. 10B is a similar graph showing vibration intensity for a racquet without tubes;

DETAILED DESCRIPTION OF ILLUSTRATED EMBODIMENT

Figure 1:
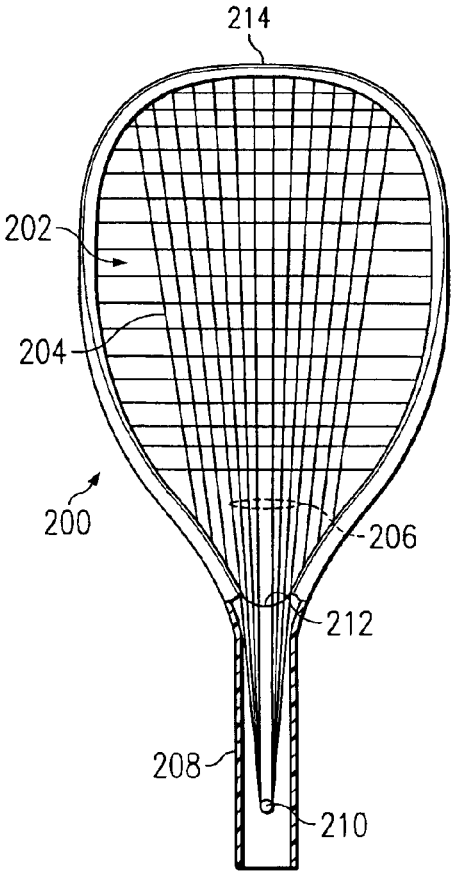
FIG. 1 (PRIOR ART)
FIG. 1 is a front plan view of a known long string racquetball racquet.
Figure 2:
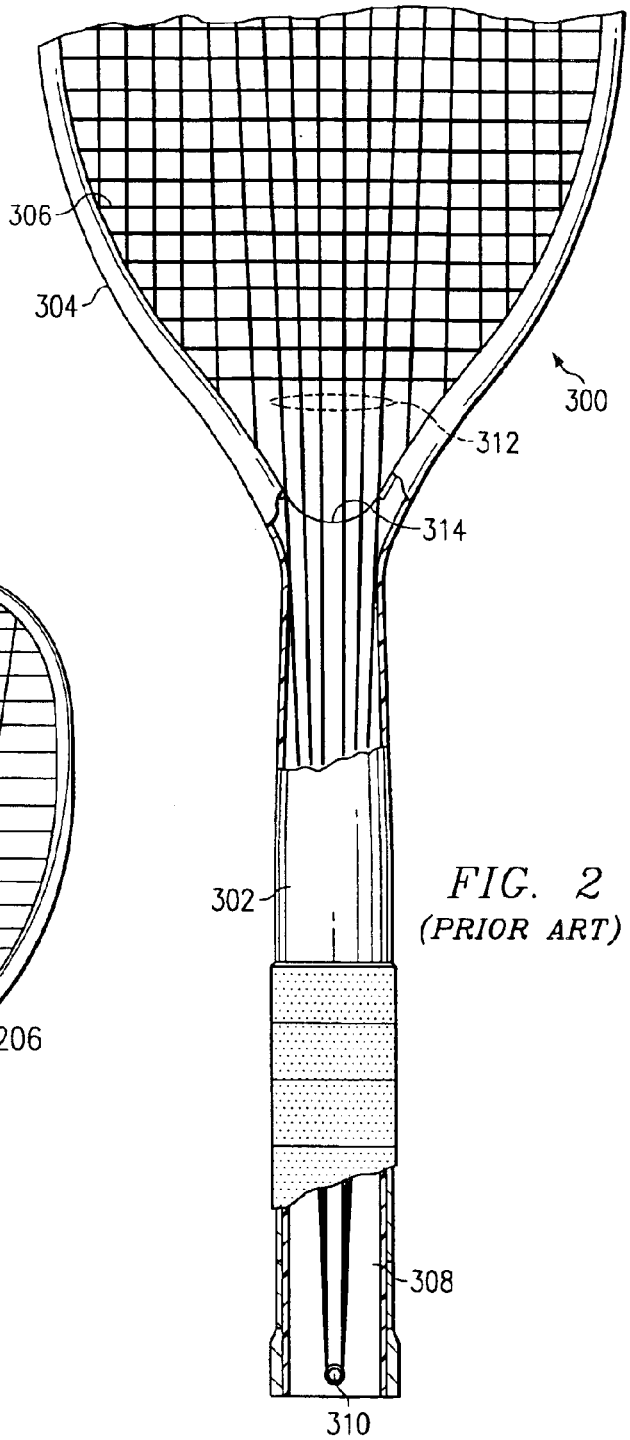
FIG. 2 (PRIOR ART)
FIG. 2 is a front plan view of a known long string tennis racket.

Referring to FIG. 3, a racquet indicated generally at 10 is shown such as a modified EF Composite Technologies, L.P.'s JUDGEMENT™ racquetball racquet (hereafter referred to as the "long string" design or racquet). The racquet 10 typically has a racquet head 12 with a frame or head frame 14 terminating in a preferably hollow stem 16, made up in this illustrated embodiment as a handle integrally formed with the frame. It also has fourteen main or vertical strings 18, including six strings secured near the bottom 20 of the frame 14, and eight long strings 22 which extend through an opening 24 in the stem 16 as disclosed in U.S. Pat. No. 5,919,904 incorporated fully herein and also as cited previously.

The main strings 18 are generally parallel to a longitudinal axis L of the racquet that extends from within the upper end or top 26 of the frame 12, through the bottom 20 of the frame and along the length of stem 16. In the illustrated embodiment, the main strings 18 are not completely parallel to each other but are generally arranged in a fan shaped configuration. In the illustrated embodiment, the racquet 10 also includes twenty-two cross strings 28.

The main strings 18 and cross strings 28 form a tensioned string bed 30 defining a plane which is laterally surrounded by the head frame 14. The string bed 30 is approximately sixteen inches long measured from an upper interior surface 26*a* of the frame top 26 to a lower interior surface or end 20*a* of the frame bottom 20 and near stem 16. The length of the string bed 30 is measured along axis or center line L.

It will be appreciated that while a single continuous string may be woven or strung with the frame to form the entire string bed 30, the term "string" as is used in main strings 18 or 22, and in cross strings 28 typically refers to a string segment between its two fixed or anchored ends on the frame or stem of the racquet unless the context of the description indicates otherwise. The present invention has application to sports racquets which are strung with one continuous length of string or two or more such lengths.

Figure 8:
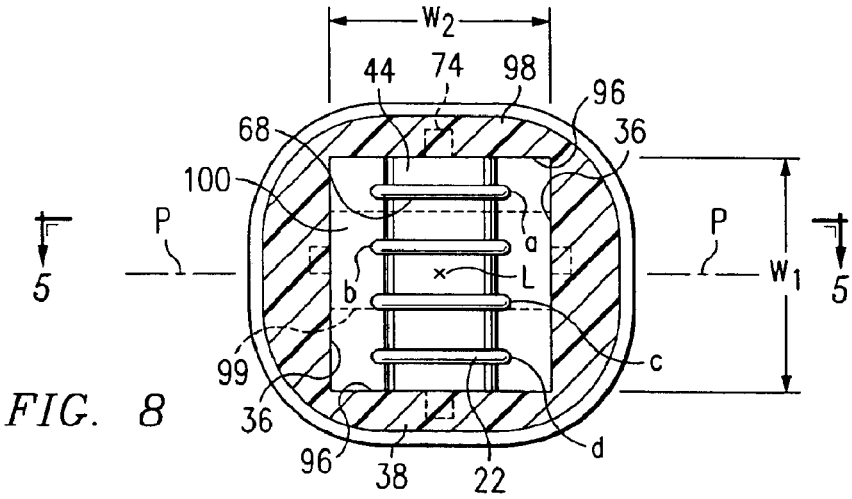
FIG. 8 is a bottom end view of the handle of the racquet according to the present invention.

The stem 16 has a near end 32 defining the opening 24 to an elongated cavity 34 defined by inner surfaces or sidewalls 36 and front/back walls 96 (shown in FIG. 8). While an integral cavity is preferred for purposes of manufacture and minimal interference with string movement, in other embodiments the cavity can be divided into two or more lumens or divisions, with ones of the main strings routed ISO through one, some or all of them. The long strings or string segments 22 extend into cavity 34 and have fixed ends preferably disposed in the vicinity of a far or distal end 38 of the stem 16 for providing an effective length for the long strings that is significantly longer than the string bed 30. The distal end 38 may have a separate cap or cover plate (not shown).

Figure 4:
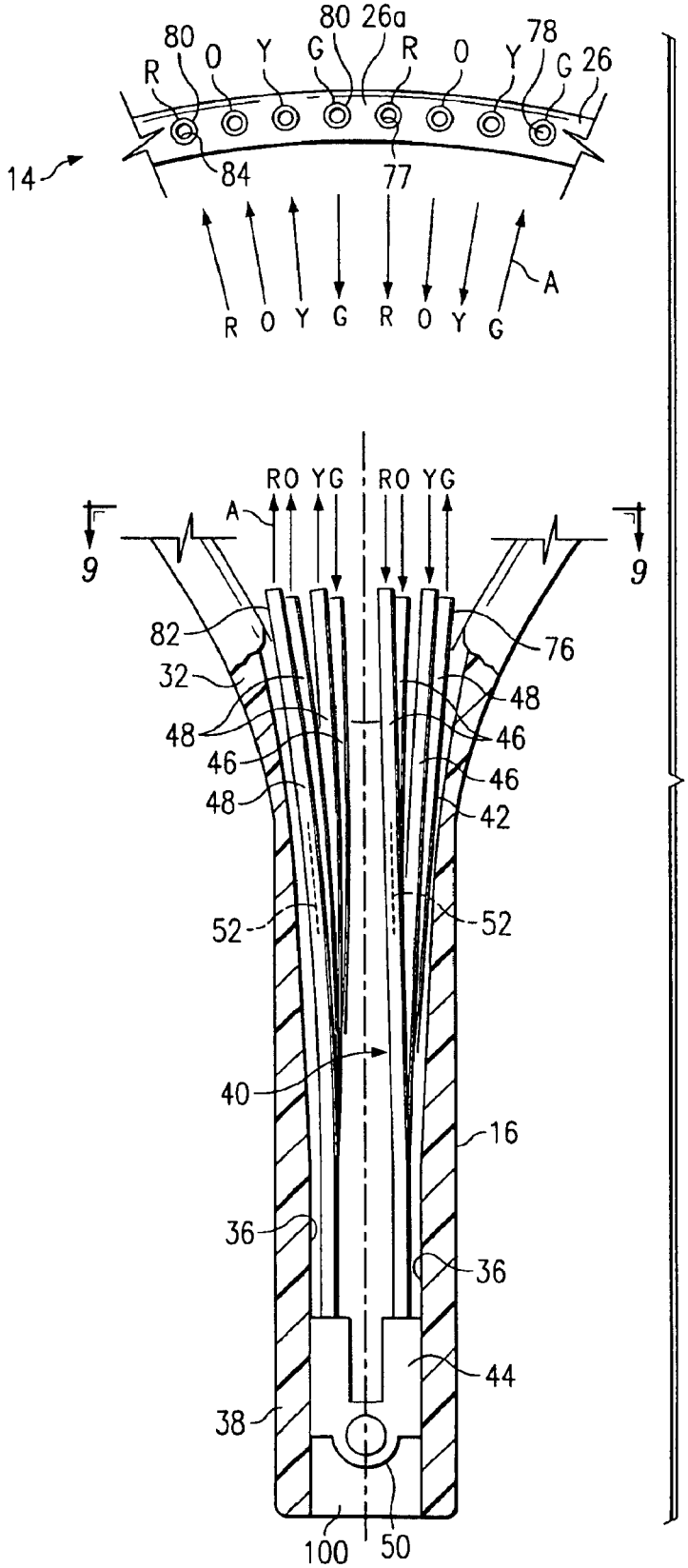
FIG. 4 is a close-up cross-sectional view of the handle of the racquet and a close-up view of a corresponding segment of a frame of the racquet of FIG. 3.
Figure 5:
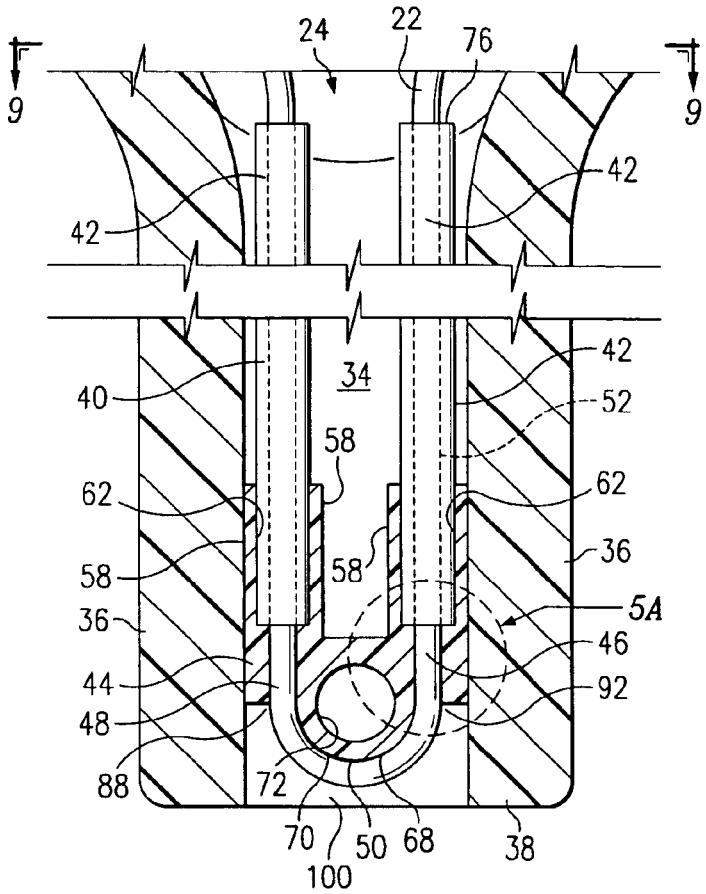
FIG. 5 is a close-up cross sectional view of the string bearing assembly in the handle of the racquet according to FIG. 4 and as taken substantially along line 5—5 of FIG. 8.
Figure 5A:
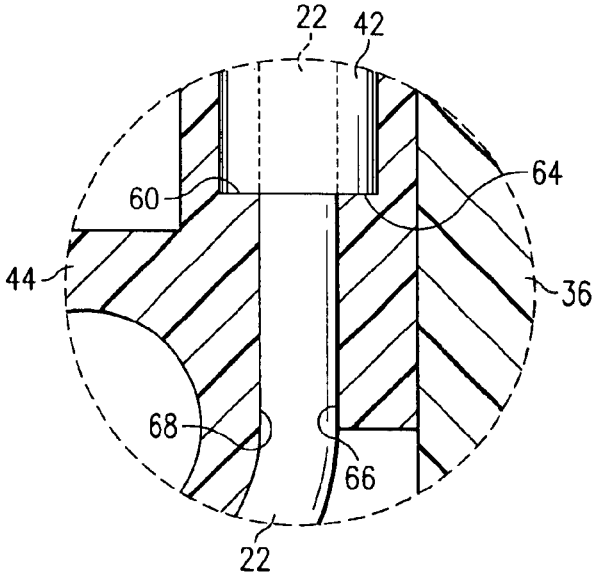
FIG. 5A is close-up of a portion of the cross sectional view of FIG. 5.

Referring to FIGS. 3–5, the racquet 10 has a string guide system 40 disposed within the cavity 34 of the stem 16 and that has tubes 42 for providing pathways or passages for each long string 22 to a string bearing or string bearing assembly 44. During stringing, the tubes 42 guide respective string segments 22 to particular, predetermined lateral positions at or near the string bearing assembly 44 which is preferably disposed in the vicinity of the distal end 38 within cavity 34. At the string bearing assembly 44, a next segment of the string is guided through a turn and back up toward the opening 24 of the cavity and toward the string bed 30. While it is preferred to locate the string bearing assembly in the vicinity of distal end 38 to maximize the length of the long strings 22, it will be appreciated that the string bearing assembly 44 can be located anywhere in stem 16 (see, e.g., assembly 324 in FIG. 11).

Since the string bearing assembly 44 is positioned at the ends of each long string 22 entering the cavity, it defines each long string or string segment 22 as either an entry segment 46 or an exit string segment 48 that are portions of a single continuous string that is threaded through the string bearing assembly 44. In other words, the segment of one long string 22 that engages a tube 42 before the string bearing assembly 44 is referred to as an entry segment 46 while the segment of the subsequent long string 22 engaging another tube after engaging the string bearing assembly 44 is deemed an exit segment 48.

The string bearing assembly 44 also defines an end 50 of the string segments 22 where the redirection of the string occurs. The bearing accepts at least a large portion of the tensile force placed on it by the strings.

In order to receive the strings 22 and establish the entry and exit segments 46, 48, the tubes 42 have hollow cores 52, with each tube preferably receiving and holding either an entry or an exit segment of each string 22. The tubes 42 have an inner diameter preselected to be larger than the diameter of the string 22 to accommodate the sliding of the string through the tubes, yet small enough so that the tube is sufficiently tight against the string segments 22 to provide a dampening effect described below. The string is typically nylon 16.

FIG. 3*a* illustrates an alternative embodiment of the invention in which a racquet 600, which in the illustrated embodiment is a racquetball racquet but which could easily be a racquet of a shafted type, has a simpler bearing 602 located at some point within the cavity of the stem 34. In this embodiment, the long strings or string segments 22 are threaded through individual tubes 42, as before. However, the tubes 42 are not affixed to any structure inside the cavity or elsewhere, but are basically free-floating.

FIG. 3*a* illustrates only one of several alternatives available for providing tubes according to the invention. For example, the tubes may be loosely or firmly attached at their midpoints inside the cavity 34, while their proximal and distal ends remain free-floating. The tubes may be loosely or firmly affixed to any other structure inside the handle cavity or to the side of the frame. While eight tubes, one provided for each long string segment, are shown in the illustrated embodiments, this number could easily vary; only the cross sectional area of the handle cavity 34 poses a physical constraint on the number of the tubes which can be used. Further, there is no absolute requirement that all string segments have such tubes, as the provision of tubes on only some string segments will still have beneficial vibration dampening effects and stringing advantages. Still further, while the illustrated embodiment shows the tubes 42 as extending through all or almost all of the available length of the internal cavity 34, they instead can be shortened to extend through only a portion of this length. While the tubes are presently illustrated as extending somewhat in a proximal or upper direction into the string bed, in other embodiments the tubes may be disposed to be entirely within the cavity 34, or may extend outwardly into the string bed by more than is presently shown. While it is preferred that the tubes 42, or at least groups of them, be connected together as webs, it is nonetheless possible to have the tubes entirely separated from each other. And while the tubes 42 are shown to occupy a single unitary channel or cavity 34, the cavity 34 can easily be subdivided into variously sized longitudinal spaces, and the tubes disposed in one or more of them.

Referring to FIGS. 5–8, the string bearing assembly 44 is situated between the two segments 46, 48, both segments preferably covered by separate tubes 42. The string bearing assembly 44 (best seen in FIG. 7) has a body 56 with sidewalls 58 and defines ferrules or bores 62 preferably with a diameter of about 3.1 mm. The bores 62 receive first ends 64 of tubes 42. Inside each bore 62, a bottom wall 60, and in turn the bottom of the bore, defines a string hole 66 that is of sufficient size (or diameter) to leave enough surface area for the end 64 of the tube 42 to abut bottom wall 60 but permits the string 22 to continue through the string hole. Here the string hole 66 is preferably 1.6 mm diameter. Each string hole 66 is disposed at an end 88, 92 of an uncovered curvilinear or U-shaped channel 68 where the string segments 22 are guided along a turn or redirected back up toward the opening 24 of the cavity and toward the string bed 30.

Figure 6:
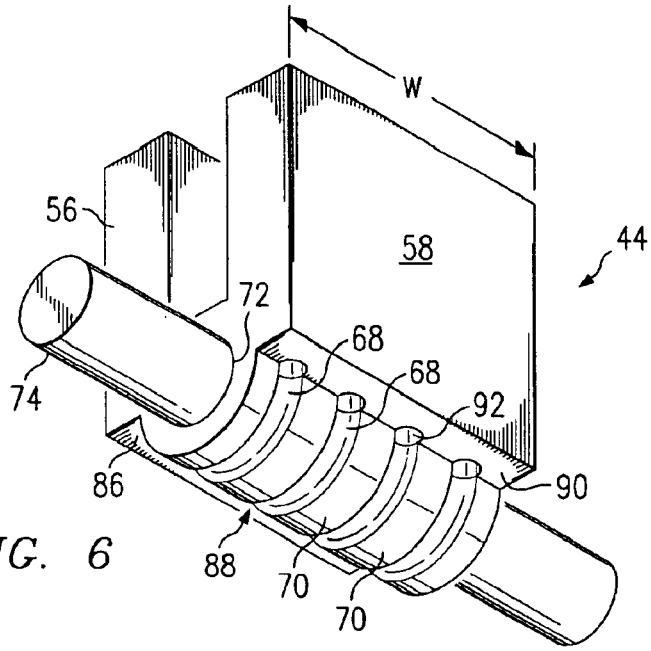
FIG. 6 is a top perspective view of a string assembly according to the present invention.
Figure 6A:
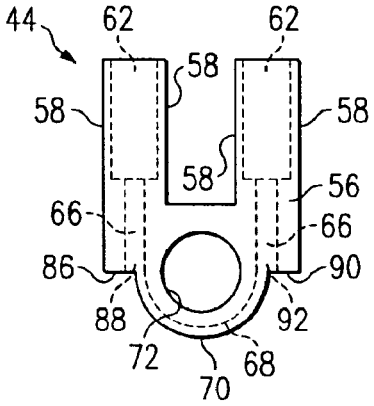
FIG. 6A is a front elevation of a string bearing assembly according to the present invention.
Figure 6B:
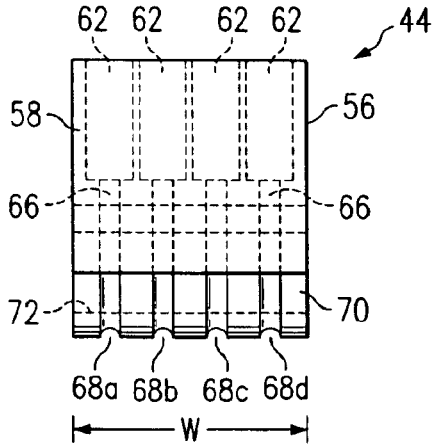
FIG. 6B is a side elevation of a string bearing assembly according to the present invention.

The channels 68 (at the bottom thereof) have a turning radius of approximately 3.2 mm to form the curve in the U-shape. This is much larger than the prior art radius of the pin, which reduces the possibility of kinks within the string 22 at the string bearing assembly 44, distributes bending stress over a longer length of the string and therefore prolongs string life. The channels 68 are preferably arcuate (as shown in FIGS. 6 and 6B) with a radius of 0.8 mm to correspond to the diameter of the string 22.

Figure 6C:
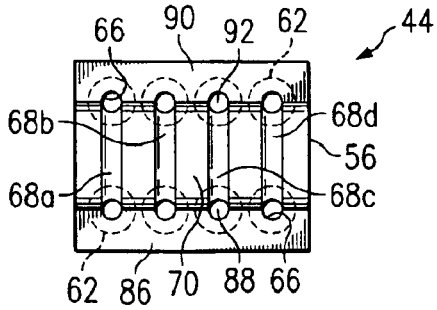
FIG. 6C is a bottom end view of a string bearing assembly according to the present invention.
Figure 7:
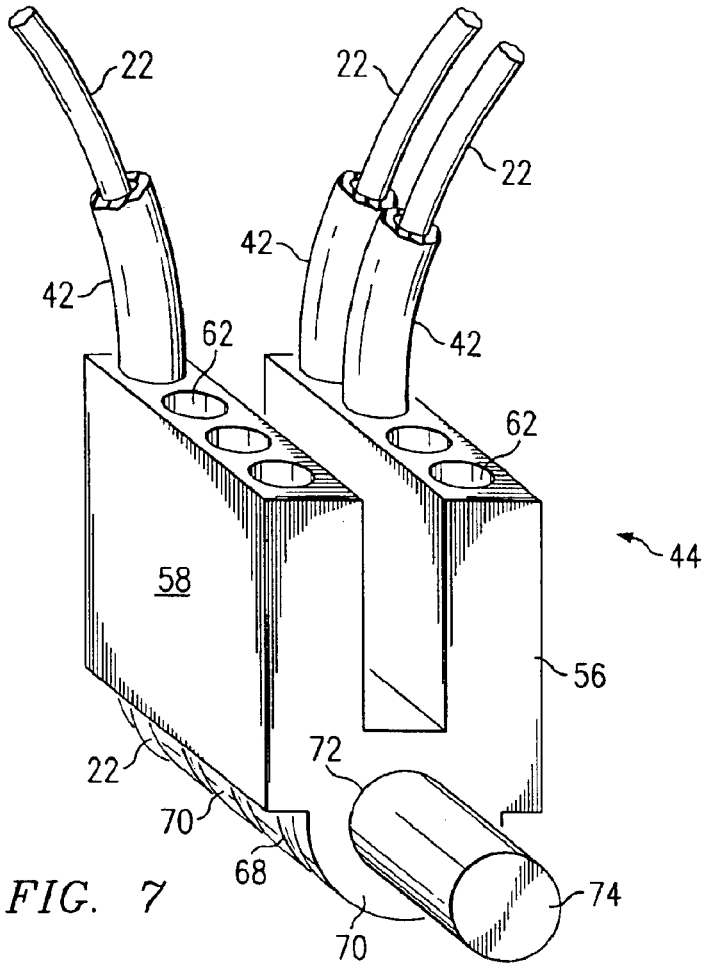
FIG. 7 is a bottom perspective view of a string bearing assembly according to the present invention.

While at least one channel 68 should be provided when only one pair of string segments 22 extends into cavity 34, the preferred configuration has multiple pairs of string segments 22 extending into the cavity 34 as shown in FIG. 4. In this case, the channels 68 are spaced apart from each other along a width "w" (shown in FIGS. 6, 6B and 6C) to avoid contact between any two strings 22. The channels 68 communicate with the bores 62 through string hole 66 so that hollow cores 52 of the tubes 42 are continuous with the channels 68. Thus, as shown in FIGS. 6B, 6C and 8, when string segments 22 are disposed on the string bearing assembly 44, each string segment 22 has a predetermined lateral position (a to d) that is along width w and transverse to axis L on the string bearing assembly so that the string segments do not touch and cannot become entangled or twisted together.

The channels 68 are preferably uncovered so that the strings 22 can extend from the string bearing assembly 44 and out of a hole 100 on the butt end 98 of the racquet (shown on FIG. 8) so that a stringer can manually bend each string back on to the string bearing assembly and into the return portion of a respective one of the channels 68. It will be appreciated, however, that the channels 68 can be completely enclosed when a string is used that can be easily redirected by a curved, covering surface (not shown) of the string bearing assembly.

Referring to FIGS. 5–8, the string bearing assembly 44 also has a transverse wall 70 defining a transversely extending aperture 72. A preferably metal pin 74 is disposed transversely within said cavity 34 and is secured to front/back walls 96 of the cavity (transverse is relative to the extending direction of longitudinal axis L). This preferably disposes pin 74 and width 'w' of the string bearing assembly 44 perpendicular to plane P defined by the string bed as shown in FIG. 8. The string bearing assembly 44 is secured to the stem 16 by mounting it on pin 74 through aperture 72.

The pin (28 mm long) is preferably longer than the width w of the string bearing assembly (15 mm) for securing to walls 96. However, the pin 74 could just as easily be secured to the inner sidewalls 36, instead of the front/back walls 96, as shown in dashed line 99 on FIG. 8. In this case, the direction of the width w of the string bearing assembly 44, and in turn, the direction of the spacing of the predetermined lateral positions, would be along $w_2$, or parallel to the string bed plane P, rather than perpendicular to P along $w_1$. In alternative embodiments, pin 74 need not extend all the way across the cavity 34, and may be limited to crossing at least one of the junctures of the string bearing assembly aperture 72 and the cavity walls 36 or 96.

Referring to FIG. 8, in the illustrated embodiment, the string bearing assembly 54 abuts and fits snugly within all four walls 36, 96 forming the cavity 34. Thus, the pin 74 can be made of any material that withstands the force pulling the string bearing assembly toward the string bed, and imparted by the strings 22, that is not absorbed by the friction between the string bearing assembly 44 and cavity walls 36 and/or 96, if any. In addition, the string bed assembly 44 can have any polygonal sidewall shape as long as it matches and/or abuts the walls of the cavity 34. The walls 36, 96 are preferably continuous with hole 100 at the butt end 98 of the stem 16 for providing easy access to the string bearing assembly 44.

The string bearing assembly 44 is preferably made by injection molding of nylon 11 and 30% injected fiber glass whiskers (chop-fibers). Of course, any material that can withstand the tensioning of the strings, typically 30 lb. per string segment, will suffice.

Referring to FIGS. 4–5A and 9, the first ends 64 of tubes 42 are preferably glued into bores 62. It will be appreciated that sidewalls 58 defining the bores 62 may be designed to hold tubes 42 entirely by friction within the bores instead of gluing them in. It is even possible for tubes 42 to be loosely fitted within bores 62. The tubes 42 preferably extend most of the length of stem 16 and have second ends 76 that preferably extend out of opening 24 and toward string bed 30.

Referring to FIG. 9, the tubes 42 are preferably 0.054" inner diameter and 0.064" outer diameter. They are also made from a polyurethane preferably with a durometer of 65 'Shore A' extruded two at a time with two different colors. This amount of flexibility provides for easy insertion of strings 22 into the tubes, pushing the strings through the tubes and into the string bearing assembly 44 while stringing the racquet.

The heat during one tube extrusion process adheres pairs of extruded adjacent tubes 42 to each other. This prevents further slapping and collisions at least between the two adjacent tubes, and reduces vibration against each other. It also provides further rigidity or stiffness to the tubes 42 for maintaining a predetermined alignment of strings at opening 24 for placement into a pre-selected string pattern. Thus, it will be appreciated that any number of the tubes 42 may be adhered together, including in one alternative for racquet 10 where all four tubes extending from a first side 86 of the string bearing assembly are adhered together and all four tubes 42 extending from a second side 90 are separately adhered together (FIG. 9A).

Referring to FIGS. 10A–10B, another primary purpose for the tubes 42 is to dampen the vibration of the strings 22 when the racquet impacts a projectile or other object (such as a wall of a racquet ball court). When the strings 22 receive vibratory forces from the strike of a projectile on the string bed, those forces are transferred to the string bearing assembly 44 and a top segment 26 of the frame that anchors the tops of long strings 22. These forces can be particularly strong in long string designs that do not have cross strings spaced along the entire length of the long strings, such as within the stem. The cross strings tend to provide a dampening effect that is missed.

Tests were performed that show that the tubes 42 do in fact dampen vibration. In one test, a Koss microphone was placed under the strings of a racquet near the center of its string bed to identify sound waveforms caused by vibration when the racquet was struck with a ball dropped 50 inches from the racquet to simulate a strike during play. The racquet was clamped to a holding structure so the racquet frame would not vibrate. The microphone was connected to a computer that was using a REALAUDIO™ spectrum analyzer and a sound card. A number of trials were performed with varying striking forces. Typical resulting waveform patterns are shown on FIGS. 10A and 10B.

In the data for both the racquet with the tubes 42 (graphed on FIG. 10A) and the racquet without the tubes (graphed on FIG. 10B), during the strike of the ball or the initial "pop", the vibration was very intense. This period consisted a frequency of 400 Hz that decayed rapidly for the dampened racquet. The initial vibration lasted 15 milliseconds for the dampened racquet, and longer than 20 milliseconds for the undampened racquet.

As can also be seen by comparing FIG. 10A to FIG. 10B, vibration falls off immediately after the ball strike with the dampened racquet but vibration continues on the undampened racquet. Specifically, vibration decayed to approximately zero with no residual vibration within eighty milliseconds of the ball strike for the dampened racquet. There is a low frequency wear that lasts about one cycle before decaying to zero. This occurred independently of the striking force. No or very little vibration was perceived in the handle or otherwise after the ball strike, no matter how hard the ball was hit.

In contrast, the undampened racquet (FIG. 10*b*) had large-amplitude vibration for at least another 125 milliseconds resulting in the establishment of a fundamental frequency of about 600 Hz. This frequency is believed to vary from racquet to racquet. This frequency is also independent of the striking force and will feel approximately the same no matter how hard the ball is struck.

To verify the results of the microphone tests shown in FIGS. 10*a* and 10*b*, two more tests were done with a piezoelectric shock accelerometer. The accelerometer was attached to a BEDLAM 195 racquet with the tubes of the invention (FIG. 14*a*) C) and without the tubes of the invention (FIG. 14*b*). The test was conducted by attaching the accelerometer to the racquets near the throat. The racquets were clamped horizontally to a holding fixture at the head and throat such that the frame could not move. A ball was dropped from a height of 50 inches on to the center of the strings.

Figure 14A:
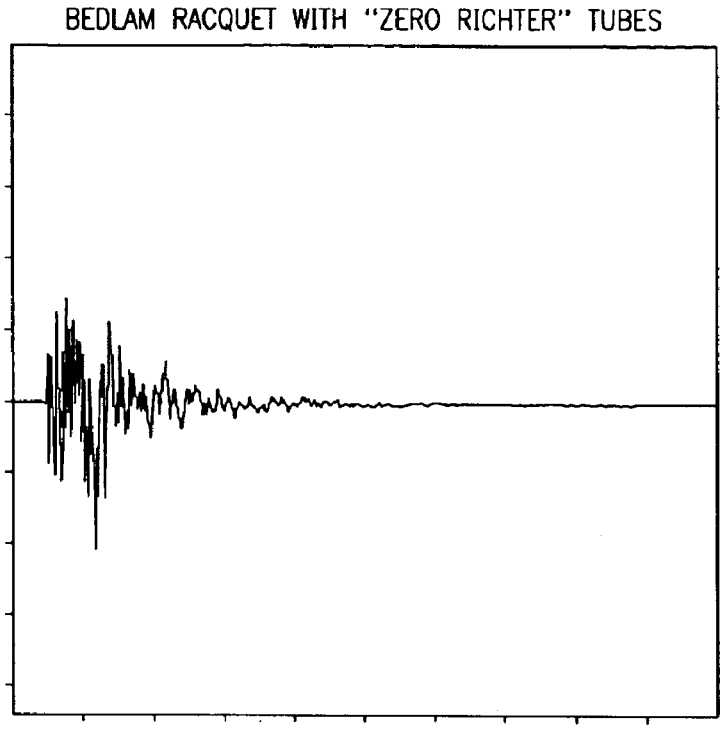
FIG. 14*a* is a graph showing vibration intensity for a racquet with tubes according to the invention, as measured with a piezoelectric shock accelerometer.
Figure 14B:
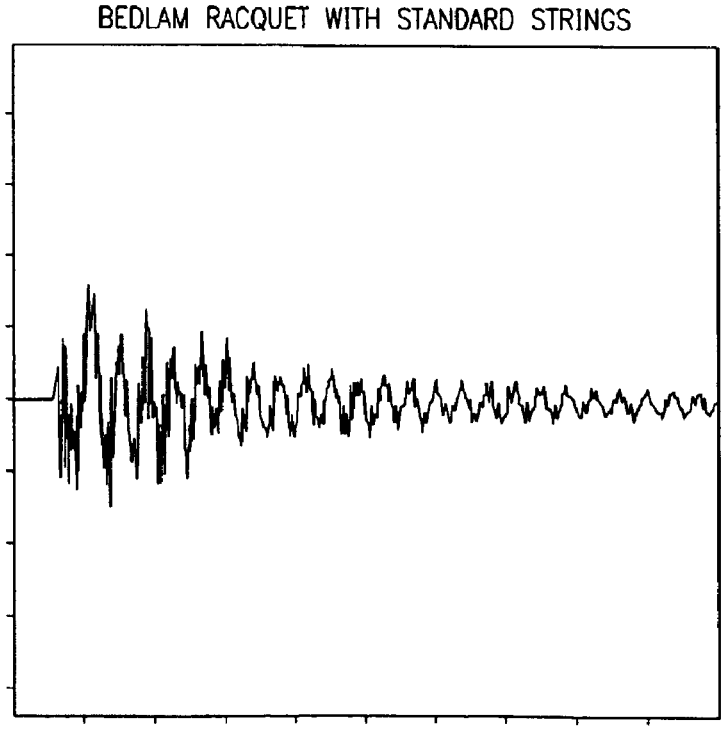
FIG. 14*b* is a graph similar to FIG. 14*a* for the same racquet but without the tubes according to the invention.

The X axes of the graph of FIGS. 14*a* and 14*b* are in time (16 milliseconds per division) and the Y axes are in Gs (acceleration of gravity).

In the undamped racquet (FIG. 14*b*), the maximum amplitude was 9.9 g. The peak amplitude duration (1.5 divisions) decays slowly for 9 divisions (16 milliseconds per division).

The racquet filled with tubes according to the invention (FIG. 14*a*) has the same peak amplitude of 9.9 g, however after 2 time divisions the amplitude is substantially less than the undamped racquet. The vibration approaches zero at approximately 3 divisions. From these data it can be seen that the invention reduces both the amount and duration of vibration.

Thus, the tubes 42, as made preferably with polyurethane of Shore 'A,' durometer reading of 65 provide much improved vibration dampening characteristics that will reduce wear on a players hand and arm and provide more comfort during play. However, any other material that provides similar dampening characteristics while having the capabilities for guiding strings 22 can be used. It will also be appreciated that the durometer, dimensions and type of material can be varied for tubes from string to string or along the length of a single tube (or on a line of separate tubes on a single string 22) in order to intentionally vary the dampening characteristics for particular strings or particular sections of strings.

Referring to FIG. 4, in another aspect of the illustrated embodiment, the tubes 42 have indicia to aid in the stringing of the racquet 10. Preferably, these indicia are provided as different colors of the tubes, each color indicating a particular string or portion of a routing order for a particular, pre-selected string pattern. The indicia could otherwise be numbers, objects, names, marks or other images printed on the tubes or tags attached to or extending from the tubes to indicate a particular tube, and in turn a particular string.

As an alternative, not every tube needs to be colored or covered with indicia. The coloring may only be on exit segment tubes or entry segments or specific individual tubes. In addition, the tubes may merely be colored or printed with indicia on a segment or end of the tube rather than the entire length of the tube.

Such an indicium for a tube 42 indicates a specific predetermined routing order to place a long string or string segment 22 at a particular location within string bed 30. This maintains a selected or predetermined string bed pattern while preventing tangling or twisting together of string segments 22 as they emerge from the stem 16.

For the illustrated racquet 10, the interior surface 26*a* of the top of the frame 26 has hole edges 77 that define a plurality of holes 78. Each hole is encircled with an indicium or color ring 80 printed on the interior surface 26*a* and that corresponds to the routing order and matches the indicium or different color of a tube 42. The holes 78 receive top ends of the long string segments 22 and connect to a grommet (not shown) disposed within the frame top 26. The running of the string through the holes forms anchor points at edges 77 on the frame 12. The long string or string segments 22 either enter the frame top 26 through holes 78 from the string bed 30 or exit the frame 26 through holes 78 to reenter the string bed 30.

In one example indicia configuration, as shown on FIG. 4, the tubes 42 and hole indicia rings 80 have colors as indicated (R=red, O=orange, Y=yellow, G=green). The direction of stringing through the holes 80 and tubes 52 is also indicated by routing arrows 'A'). The top 26 of the frame in FIG. 4 is aligned with the tubes 52 extending from the stem 16 to show the stringing pattern. Thus, a selected tube 82, for example, engaging a segment of a string 22 has a corresponding color (here red) that corresponds to a color of one of the holes (here red ring 80 on hole 84) where the string is to engage consecutively with the engagement of tube 82. Similarly, the string from the orange tube is to be placed in the orange hole, the string from the yellow tube is to be placed in the yellow hole, and so on. Preferably, consecutive pairs of entry segment 46 and exit segment 48 along the continuous string have tubes 42 of the same color covering both segments. This way a stringer can immediately see where the string 22 he just inserted into the string-guide system 40 in the cavity 34 exited the cavity.

It will be appreciated that while the corresponding hole-tube colors and corresponding exit/entry segments are the same color here, the colors may be off (i.e. different hues, brightness, etc.) or may be completely different colors that correspond based on a color table or chart provided with or on the racquet (not shown) that shows, for instance, that the string from the black tube is to be placed in the white hole, the string from the yellow tube is to be placed in a green hole, as some examples.

The indicia on the frame 14 may be other than colored rings, such as alphanumeric characters, whether of different colors or not, and may be of different objects or shapes, such as arrows either pointing toward certain holes on the frame or indicating the route of the string through the top frame portion 26.

Still referring to FIGS. 4 and 6, the color coding and arrows A also show that the string guide system 40 is adaptable to accommodate many different string patterns that require string segments 22 to enter the stem 16 in a certain direction or position. The stringing process to form long strings 22 does not require that the strings always enter the string guide system 40, and in turn the string bearing assembly 44, from the same side of the stem. In other words, keeping in mind that the first side 86 of the string bearing assembly 44 has all of the first ends 88 of the curvilinear channels 68, and the second side 90 has all of the second ends 92 of the curvilinear channels, a desired stringing pattern can have at least one string first engaging one of the channels 68 on each side 86, 90 of the string bearing assembly 44. Here, the string 22 received by the red, orange and yellow tubes 42 have strings first engaging the first side 86 of the string bearing assembly 54, and the green tube 42 has a string 22 first engaging the second side 90 of the string bearing assembly.

Referring to FIG. 3, the string guide system 40 will work for any number of long strings or string segments 22 that fit into the cavity 34 of the stem 16. Even if the racquet 10 only has one pair of long string segments 22 that extend into the stem 16, the tube(s) 42 and/or the string bearing assembly 44 should be provided for dampening vibration and redirecting the string back to the string bed 30 to reduce collision between the entry segment 46 and exit segment 48 of the string segments 22. In addition, a single string may extend and end within the stem (such as being tied to a pin within the cavity). This string would also at least benefit from dampening by a tube 42.

While it is preferred that every string segment 22 that enters cavity 34 engage a tube 42 due to the directing, indicia and dampening affects of the tube, it will be appreciated that not all of the entry and exit segments of the string segments 22 in the cavity 34 must be encased in tubes 42 if so desired.

The method of stringing racquet 10 can be broken down into four main steps:

(1) engaging the string guide system 40 by inserting an end of a single continuous string 94 into a selected entry segment tube 42 of the string guide system 40. The continuous string 94 preferably forms a plurality of, and preferably all, strings on the racquet including strings 22. The selected tube 42 is disposed at the near end 32 of the stem 16 where it is easy for a stringer to reach and hold the string 94 and tube 4.

(2) moving the string 94 through the string guide system 40 by pushing the string through the entry segment tube 4 from the near end 32 of the stem 16, and through the cavity 34 to form the entry segment 46. Then the string 94 is placed into and through the string bearing assembly 44 disposed at the distal end of the stem, and back through the cavity 34 to the near end 76 of an exit segment tube 42 to form an adjacent or consecutive long string 22.

(3) extracting the string 94 (or end of the string) from the exit segment tube 42 of the string guide system 40, and moving it into and through string bed 30.

Finally, (4) inserting the string end in one hole 80 on the frame top 26 and extracting it from another hole 80 to bring the string back into the string bed 30. This process is repeated to form all of the main long strings or string segments 22.

The step of moving the string 94 through the string guide system 40 includes directing the string 94 through the selected tube 42 and to a particular channel 68 for positioning the string at the turning point 44. This positions string 94 at a particular or predetermined lateral position (a–d) relative to the longitudinal axis L at the string bearing assembly 44, which avoids undesired contact between strings 22.

For uncovered channels 68, the string 94 first extends through string hole 66 and continues straight toward the back end 98 of the stem 16. A stringer must then bend the string 94 to insert the end of the string back into the string bearing assembly 44 at the other end 92 of the channel 68. Once the string 94 lies within the channel 68 it is redirected in a direction pointing back toward the string bed 30.

The stringer must then push the string back through the string bearing assembly 44 and through the exit segment tube 42. Once the string emerges from the second end 76 of the exit segment tube 42, the string can be extracted from the second end until the string is taut and lays flush within channel 68. With this process, the string 94 can be strung through stem 16 without entangling or twisting string segments 22 together and while maintaining a configuration in the stem 16 that avoids any direct contact between the strings. The process then continues with the weaving into the string bed 30.

When extracting the string 94 from a tube 42, the stringer looks at the indicia of that tube (i.e. what color it is), and then looks for the hole 78 on the frame top 26 that has the corresponding color or color ring 80 in order to decide which hole to place string 90 into next. The stringer then strings string 90 through the string bed and into that hole 78 with the corresponding color.

Figure 12:
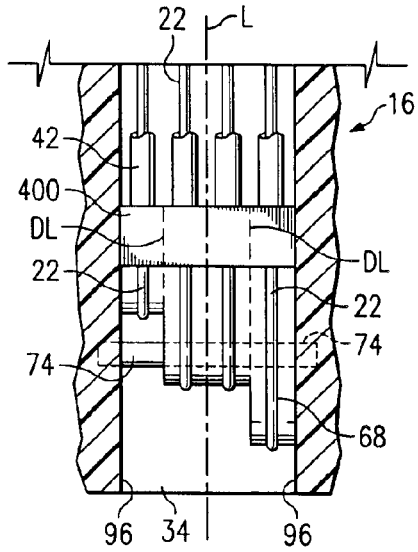
FIG. 12 is a close-up cross-sectional view in a stem of a racquet exposing a front elevation of an alternative design for a string bearing assembly according to the present invention.

The string guide system according to the invention is particularly advantageous when used with a "long string" racquet design like those shown in FIGS. 3 and 12. This is because stringing a large number of string segments through a long enclosed tube, such as a racquet handle or shaft, while keeping them disentangled from one another, can otherwise be quite difficult. The monofilament nylon string typically used on racquets tends to be unruly and will have a tendency to curl and involute upon itself if given a chance. By providing enclosed stringing conduits, tubes 42 obviate this disadvantage of the long string racquet structure.

Figure 11:
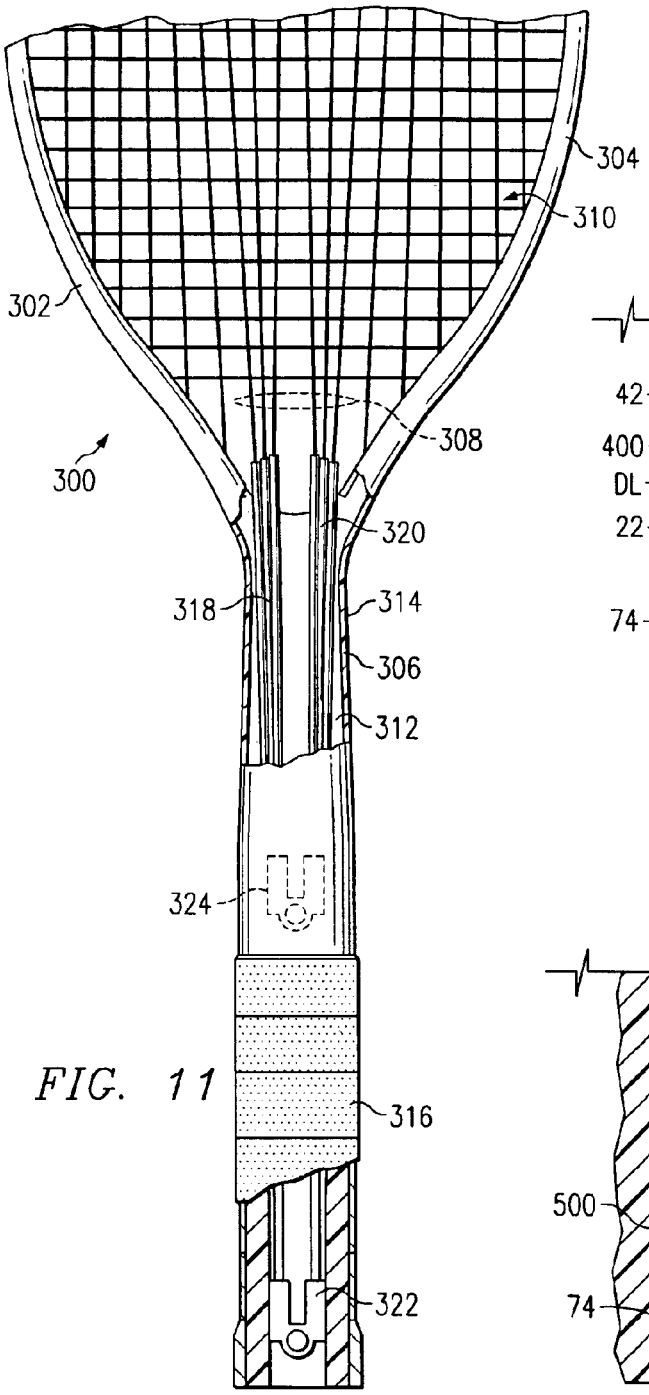
FIG. 11 is a front plan view of another racquet according to the present invention.

Referring to FIG. 11, in an alternative embodiment, a long string racket 300 has a racquet head 302 with a frame 304 connected to a stem 306. Long strings 308 extend from a string bed 310 and into a cavity 312 defined by the stem. Here the stem 306 includes a shaft 314 that connects a handle 316 to the racquet head 302 or frame 304. A string guide system 318 includes tubes 320 and a string bearing assembly 322 disposed within the handle 316, or in the alternative, a string bearing assembly 324 disposed only within the shaft 314. If only disposed in the shaft, some sort of opening or removable panel (not shown) on the side of the shaft most likely will be needed to provide access to the assembly 324. The tubes 320 preferably extend from the vicinity of the string bed 310 to either of the string bearing assembly positions. While in the illustrated embodiment six long strings 308 are shown it can be any number of long strings that fit into the stem 306.

Figure 13:
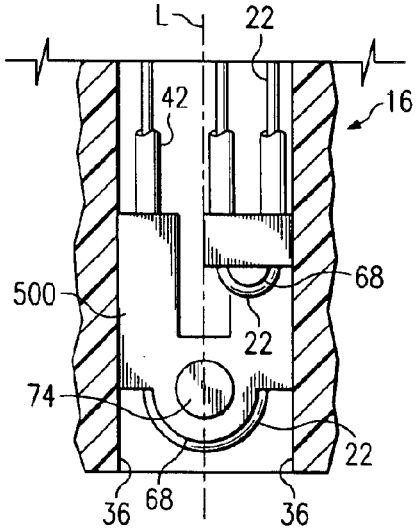
FIG. 13 is a close-up cross-sectional view in a stem of a racquet exposing a side elevation of an another alternative design for a string bearing assembly according to the present invention.

Referring to FIGS. 12–13, in other alternatives, modified string bearing assemblies 400 and 500 for racquet 10 may be used that does not align all of the turning areas and curvilinear channels in a single horizontal array as shown in FIGS. 5–6. All features similar to that shown in FIGS. 3–9 are numbered similarly. The lengths of the channels 68 on the string bearing assembly 400 may vary longitudinally to accommodate different string segment lengths, and in turn different deflections, for long string segments 22 (as shown in FIG. 12). This can be accomplished by extending curvilinear channels 68.

Referring to FIG. 13, the positions for the channels 68 of the string bearing assembly 500 may also vary laterally (with or without longitudinal variation as in FIG. 12) to provide desired, particular angles for a string 22 to enter a string bed 30. In other words, the string bearing assembly 500 may have different radii as shown or the center of the radii may be in different lateral locations relative to axis L.

String bearing assemblies 400, 500 can be provided in many different configurations as long as the strings and tubes are positioned to avoid a pin 74 if a pin is used at all (i.e., while not preferred, the snug fit of the cavity 34 around the string bearing assembly 400 or 500 may alone create enough friction to secure the assembly, or the cavity 34 may be provided with an internal shoulder or stop longitudinally upward from the bearing assembly 400/500 to prevent upward movement thereof after strings 22 have been tensioned around it).

Also referring to FIG. 12, in yet another alternative, a modified string bearing assembly 400 can include separate pieces as shown by dashed lines DL where each predetermined deflections for each of the strings. The strings 22 can be engaged by any number of corresponding separate parts including one for each string. The separate parts also do not necessarily need to abut each other and could include a solid block that traverses the entire width of cavity 34 to secure the part within the cavity.

The advantages of the present racquet are now apparent. The racquet 10 has a string-guide system 40 disposed within a stem 16 of the racquet and has tubes 42 connected to a string bearing assembly 44 for guiding a string through a cavity 34 of the stem 16. This structure permits a string 22 to be guided through the cavity 34 and disposed in a configuration that avoids entanglement or twisting of strings in the cavity. The tubes 42 also dampen vibration of strings 22 and provide indicia for indicating a routing order for a particular string bed pattern.

While various embodiments of the present invention have been described, it should be understood that other modifications and alternatives can be made without departing from the spirit and scope of the invention, which should be determined from the appended claims.

I claim:

1. A sports racquet for hitting a projectile, comprising:

a racquet head having a frame;

a string bed supported by said frame;

a stem attached to said frame and having inner walls defining a cavity, said stem having a longitudinal axis extending a length of said stem and intersecting said string bed;

a plurality of string segments extending from said string bed and into said cavity of said stem; and a string guide system disposed within said stem for guiding said string segments within said cavity, the string guide system defining, for each string segment, a respective pathway or passage such that no string segment will contact any other string segment within the cavity.

2. The racquet of claim 1, wherein said string guide system dampens vibrations of said string segments within said stem.

3. A sports racquet for hitting a projectile, comprising:

a racquet head having a frame;

a strings bed supported by the frame;

a stem attached to the frame and having inner walls defining a cavity, the stem having a longitudinal axis extending a length of the stem and intersecting the string bed;

a plurality of string segments extending from the string bed and into the cavity of the stem; and a string guide system for guiding the string segments within the cavity, the string guide system including tubes disposed within said cavity and receiving ones of said string segments.

4. The racquet of claim 3, wherein said tubes have indicia corresponding to a routing order for stringing the racquet through said string guide system and said stem for maintaining said string segments in a predetermined alignment within said cavity.

5. The racquet of claim 4, wherein said indicia of said tubes includes said tubes being different colors, said colors indicating said routing order.

6. The racquet of claim 5, wherein both said string segments of at least one said pair of consecutive string segments are the same color.

7. The racquet of claim 4, wherein said frame includes hole edges defining a plurality of holes for receiving said string segments from said string bed, said hole edges having indicia corresponding to said routing order.

8. The racquet of claim 7, wherein said indicia of both said tubes and said hole edges include different colors indicating said routing order.

9. The racquet of claim 8, wherein a color of a preselected tube corresponds to a color of a preselected hole edge for a string to be received consecutively between said preselected tube and said preselected hole edge for maintaining said routing order.

10. The racquet of claim 3, wherein said stem is a handle or a shaft connecting a handle to said racquet head.

11. A sports racquet for hitting a projectile, comprising:

a racquet head having a frame;

a stem attached to the frame and having inner walls defining a cavity, the stem having a longitudinal axis extending a length of the stem and intersecting the string bed;

at least one continuous string having a plurality of string segments extending from the string bed and into the cavity;

a string guide system disposed within the stem for guiding said at least one continuous string at least through a turn for redirecting said at least one continuous string back out of the cavity and into the string bed, said redirection defining shared ends of a pair of connected, consecutive ones of said string segments;

a string bearing assembly of the string guide system, the string bearing assembly defining a width that extends transversely to said longitudinal axis and disposing the string segments at predetermined lateral positions along said width at said turn, the string bearing assembly having curvilinear channels disposed at said predetermined lateral positions for guiding said at least one continuous string through said turn to redirect said continuous string back toward the string bed, and for disposing pairs of string segments at said predetermined lateral positions;

each said channel having a first and a second end, said string guide system further including a plurality of tubes connected to said string bearing assembly, said tubes having first ends connected to said first and second ends of said channels, said tubes generally extending along a length of said cavity and having second ends facing said string bed, said tubes having hollow cores continuous with said channels for continuously receiving said continuous string.

12. The racquet of claim 11, wherein said tubes are configured for dampening vibration of said string segments when said strings impact the projectile.

13. The racquet of claim 11, wherein at least two adjacent tubes are joined to each other along a length of said tubes generally parallel to said longitudinal axis to reduce said adjacent tubes vibrating against each other during use of the racquet.

14. The racquet of claim 13, wherein said tubes are joined to each other so that said tubes extend toward said string bed in a predetermined general alignment for maintaining an order of said string segments in said alignment as said string segments are extending from said second ends of said tubes and toward said string bed, said order relating to a predetermined string pattern.

15. The racquet of claim 11, wherein said tubes are aligned on said string bearing assembly and disposed in said cavity for providing a generally untangled and untwisted path among said string segments and from said string bearing assembly to said second ends of said tubes, whereby said string segments extend from said second ends of said tubes and into predetermined positions on said string bed for a preselected string pattern of said string bed.

16. A sports racquet for hitting a projectile, comprising:

a racquet head having a frame;

a string bed supported by said frame;

a stem attached to said frame and having inner walls defining a cavity, the stem having a longitudinal axis extending a length of the stem and intersecting the string bed;

a plurality of string segments extending from said string bed and into the cavity of the stem, and a string guide system for guiding the string segments within the cavity, said string guide system including at least one flexible tube disposed at least partially within said cavity for receiving at least one said string segment, said tube generally extending along the length of said cavity and having an end facing in a direction pointing toward said string bed to dispose said string segment at a selected location on said string bed for a particular string bed pattern.

17. A racquet for hitting a projectile, comprising:

a racquet head with a frame supporting a string bed;

a stem attached to said racquet head and defining a generally elongated cavity therein, and generally defining a longitudinal direction that intersects said string bed;

a number of preselected string segments extending from said string bed and into said cavity; and tubes disposed within said cavity, said string segments being disposed within said tubes, wherein said tubes dampen vibration of said string segments.

18. The racquet of claim 17, wherein said stem has a distal end opposing a near end attached to said frame, said near end defining an opening to said cavity; and wherein said stem includes a string bearing assembly providing a predetermined fixed point in a vicinity of said distal end for each said string segment extending into said cavity, said tubes extending from outside said opening to within said cavity and to said vicinity of said distal end.

19. The racquet of claim 17, wherein said elongate cavity generally defines a longitudinal axis, and wherein adjacent said tubes are joined to each other along a length generally parallel to said longitudinal axis for substantially eliminating collisions between said adjacent tubes when said string bed impacts an object.

20. The racquet of claim 19, wherein said tubes have near ends facing said string bed, said near ends of said tubes being generally aligned relative to each other for placing said strings extending from said near ends of said tubes into predetermined positions on said string bed without said strings crossing to reach said predetermined positions.

21. The racquet of claim 17, wherein said tubes are flexible.

22. The racquet of claim 17, further comprising a continuous string defining pairs of consecutive said string segments sharing an end within said cavity, the racquet further comprising a string bearing assembly disposed within said cavity and guiding said continuous string through a turn for redirected said continuous string back toward said string bed, said shared end of said pair of consecutive string segments being disposed at said string bearing assembly, and wherein said tubes are disposed on respective ones of said string segments.

23. The racquet of claim 22, wherein said tubes have indicia corresponding to a routing order for stringing the racquet through said string guide system.

24. The racquet of claim 23, wherein said indicia of said tubes includes said tubes being different colors, said colors indicating said routing order.

25. The racquet of claim 23, wherein each said pair of consecutive string segments are the same color.

26. The racquet of claim 23, wherein said frame includes hole edges defining a plurality of holes for receiving said strings of said string bed, said hole edges having indicia corresponding to said routing order.

27. The racquet of claim 26, wherein said indicia of both said tubes and said hole edges include different colors indicating said routing order.

28. The racquet of claim 27, wherein a color of a preselected tube corresponds to a color of a preselected hole edge for a string segment to be received consecutively between said preselected tube and said preselected hole edge for maintaining said routing order.

29. The racquet of claim 17, further comprising a continuous string defining pairs of consecutive said string segments sharing an end within said cavity, and further comprising a string bearing assembly having a width and guiding said continuous string through a turn within said cavity for redirecting said continuous string in a direction back toward said string bed, said string bearing assembly disposing said strings at predetermined lateral positions along said width so that none of the string segments contact each other at least through said turn except for said shared ends of said consecutive string segments, said tubes being disposed between said string bearing assembly and said string bed.

30. The racquet of claim 29, wherein said string bearing assembly has a plurality of curvilinear channels engaging said continuous string for redirecting said continuous string back out of said cavity and in a direction toward said string bed.

31. The racquet of claim 30, wherein said stem generally defines a longitudinal axis, and wherein said string bearing assembly is secured to a pin secured transversely to said stem relative to said axis and disposed within said cavity.

32. A racquet for hitting a projectile, comprising:

a racquet head having a frame;

a string bed supported by said frame;

a stem attached to said frame and having inner walls defining a cavity, a near end defining an opening to said cavity and adjacent said string bed, and a distal end;

at least one continuous string extending from said string bed, through said opening and into said cavity, said continuous string including pairs of consecutive string segments connected at a shared end; and a string guide system disposed within said cavity and including:

tubes extending from a vicinity of said opening to a vicinity of said distal end for receiving said string segments; and a string bearing assembly within said cavity and spaced away from said near end in a direction toward said distal end, said string bearing assembly having curvilinear channels with two ends, and bores for receiving said tubes and disposing said tubes to communicate with each end of said channels, wherein said tubes are continuous with said channels for continuously receiving said continuous string.

33. The racquet of claim 32, wherein said string bearing assembly has a body with sidewalls and a bottom wall defining each bore, said bottom wall separating said bore from said channel ends, said bottom wall having a string hole of sufficient size to permit said bottom wall to abut an end of said tube while permitting said continuous string disposed within said tube to extend through said string hole and onto said channel.

34. The racquet of claim 32, wherein said stem includes a pin disposed transversely within said cavity, said string bearing assembly having a transverse wall defining an aperture for receiving said pin, whereby said string bearing assembly is secured to said stem, said transverse wall forming a general shape of said curvilinear channels.

35. A method of stringing a string bed on a racquet having a frame supporting the string bed and a stem attached to said frame, said stem and frame generally defining a longitudinal axis, the method comprising the steps of:

(a) engaging an end of a string into a string guide system in a vicinity of a near end of said stem, said string guide system being disposed within a cavity defined by said stem, said near end of said stem disposed adjacent said string bed and defining an opening to said cavity;

(b) moving said string through said string guide system, including:

passing said string through a first pathway or passage within the cavity, directing said string toward a vicinity of a string bearing assembly of said cavity, disposing said string at a predetermined lateral position relative to said longitudinal axis and along a width of said string guide system within said cavity for guiding said string through a turn to redirect said string in a direction back toward said string bed, said string including pairs of consecutive string segments connected at a shared end disposed at said turn, and passing said string through a second pathway or passage within the cavity back to said near end of said stem, so that there is no contact between the string segment in the first pathway or passage and the string segment in the second pathway or passage;

(c) extracting said end of said string from said string guide system and moving said string through said string bed;

(d) subsequently inserting said string end in a hole formed on an inner surface of said frame for anchoring said string to said frame and extracting said end of said string through a hole on said inner surface of said frame for moving said string back into said string bed; and (e) repeating steps (a) through (d) to form a plurality of said string segments housed within respective passages or pathways, wherein each said string segment disposed within said cavity avoids entanglement with, and direct contact with, any other string segment in said cavity.

36. A method of stringing a string bed on a racquet having a frame supporting the string bed and a stem attached to the frame, the frame and the stem generally defining a longitudinal axis, the method comprising the steps of:

disposing a plurality of tubes such that each tube at least partially resides within a cavity formed by the stem;

inserting an end of a string into an end of a first of the plurality of tubes in a vicinity of a near end of said stem;

threading the string through the first tube tow ard a vicinity of a string bearing assembly in the cavity;

redirecting the string from the string bearing assembly to the near end of the stem by threading the string through a second of the plurality of tubes; and extracting said string from an end of the second tube, said tubes dampening vibration of said string segments when said racquet impacts an object.

37. The method according to claim 36, wherein said step of redirecting said string includes moving said string through a curvilinear channel on said string bearing assembly.

38. The method according to claim 37, wherein said first and second tubes guide said string into and out of said string bearing assembly by both tubes being continuous with said channel.

39. The method according to claim 36, wherein said step of moving includes running said string end from said string bearing assembly and into a second said tube connected to said string bearing assembly, and said step of extracting includes extracting said string end from said second tube to pull said string back into said string bed.

40. The method according to claim 36, further comprising the steps of:

moving said string out of one said tube, said tube having a particular indicium indicating a stringing order, moving said string through said string bed and then to a part of said frame, reinserting said string back into said string bed, selecting which tube said string should then be inserted into by looking for a tube with a particular indicium, and inserting said string into said selected tube.

41. The method of claim 40, wherein said indicium includes said tubes being a particular color.

42. The method according to claim 40, wherein edges on said frame define a plurality of holes, said hole edges having indicia relating to said string order, said string being consecutively received between a said hole edge and a said tube that have corresponding indicia.

43. The method according to claim 42, wherein said indicia includes said tubes and said hole edge being the same color.

* * * * *